United States Patent [19]

Grieshaber et al.

[11] Patent Number: 4,624,230

[45] Date of Patent: Nov. 25, 1986

[54] METHOD AND APPARATUS FOR DETERMINING THE FULL-LOAD LIMIT OF AN INTERNAL COMBUSTION ENGINE

[75] Inventors: Hermann Grieshaber; Hermann Kull, both of Stuttgart, Fed. Rep. of Germany

[73] Assignee: Robert Bosch GmbH, Stuttgart, Fed. Rep. of Germany

[21] Appl. No.: 683,702

[22] Filed: Dec. 19, 1984

[30] Foreign Application Priority Data

Jan. 10, 1984 [DE] Fed. Rep. of Germany ..... 3400513

[51] Int. Cl.[4] ..... F02D 41/30

[52] U.S. Cl. ..... 123/445; 123/478

[58] Field of Search ..... 123/478, 480, 445, 446

[56] References Cited

U.S. PATENT DOCUMENTS

| | | | |
|---|---|---|---|
| 4,335,695 | 6/1982 | Phipps | 123/478 |
| 4,357,920 | 11/1982 | Stumpp et al. | 123/446 |
| 4,423,713 | 1/1984 | Sami et al. | 123/480 |
| 4,457,282 | 7/1984 | Muramatsu et al. | 123/480 |

*Primary Examiner*—Andrew M. Dolinar

*Attorney, Agent, or Firm*—Walter Ottesen

[57] ABSTRACT

The invention is directed to a method for determining the full-load limit of an internal combustion engine wherein a limit surface of a predeterminative full-load characteristic field is shifted to thereby compensate for the manufacturing tolerances occurring in the production of the internal combustion engine. The embodiment described relates to a diesel engine equipped with an electronic control unit. The full-load characteristic field of this internal combustion engine includes a smoke limit surface, an exhaust gas temperature limit surface and a combustion pressure limit surface. A further limit surface of constant torque is added to these limit surfaces. In order to provide for compensation of the manufacturing tolerances occurring in the production of internal combustion engines, the constant torque limit surface is shifted so as to possess a specific predeterminative value. In the subsequent operation of the internal combustion engine, a minimum value selection takes place so that at a specific air quantity always the smallest fuel quantity defined by one of the limit surfaces is injected into the internal combustion engine. An apparatus for carrying out the method of the invention is also disclosed.

1 Claim, 3 Drawing Figures

METHOD AND APPARATUS FOR DETERMINING THE FULL-LOAD LIMIT OF AN INTERNAL COMBUSTION ENGINE

FIELD OF THE INVENTION

The invention relates to a method for determining the full-load limit of an internal combustion engine with a predeterminative full-load field of characteristics which is at least two-dimensional and which determines the dependence of the maximum mass of fuel to be supplied to the engine from at least the rotational speed thereof. The invention also relates to an apparatus for performing the method.

BACKGROUND OF THE INVENTION

It is known to limit the fuel metered to an internal combustion engine by determining, with the aid of a characteristic, the maximum amount of fuel that may be injected into the internal combustion engine at a specific rotational speed. This full-load characteristic is generated by specific limit values of the internal combustion engine. Thus, for example, only such an amount of fuel may be injected that the exhaust gas temperature of the internal combustion engine does not exceed a specific value. The same applies to the rotational speed of the internal combustion engine. More specifically, only such an amount of fuel may be injected that the rotational speed of the internal combustion engine does not exceed a specific value and that the internal combustion engine is not damaged thereby. Further, such limits may be established, for example, by setting limit values for the pollutant emission of the exhaust gases of the internal combustion engine and by setting limit values for the maximum permissible pressure in the combustion chamber of the internal combustion engine, et cetera.

In the development of an internal combustion engine, this full-load characteristic is determined on the basis of tests, for example. In subsequent series production of the internal combustion engine, the maximum amount of fuel to be injected is set for each rotational speed on each individual engine in accordance with the determined characteristic.

This method for full-load limitation of an internal combustion engine has the disadvantage that the amount of air supplied to the internal combustion engine is not taken into account in the determination of the full-load characteristic. As a result, changing air pressure or changing air temperature greatly change, for example, the composition of the exhaust gases of the internal combustion engine or also its power rating. Further, the fixed allocation of a maximum amount of fuel to be injected at a specific speed does not make allowance for the manufacturing tolerances that occur in the production of the individual internal combustion engines. Accordingly, the individual engines will have different torque patterns.

SUMMARY OF THE INVENTION

By contrast with the state of the art referred to above, the method for determining the full-load limit of an internal combustion engine according to the invention affords the advantage of considering the amount of air supplied to the internal combustion engine and the manufacturing tolerances occurring in the production of internal combustion engines, which results in an optimum adaptation of the full-load limit to all occurring loads of the internal combustion engine as well as to each individual internal combustion engine.

The method of the invention determines the full-load limit of an internal combustion engine with a predeterminative full-load field of characteristics which is at least two-dimensional and which determines the dependence of the maximum mass of fuel to be supplied to the engine from at least the rotational speed thereof. The method includes the step of influencing only one specific region of the full-load field of characteristics for adapting a plurality of said engines to each other.

Advantageous embodiments and improvements of the invention will become apparent from the subsequent description, from the drawing and from the appended claims.

BRIEF DESCRIPTION OF THE DRAWING

The method and apparatus of the invention will be described in more detail with reference to the drawing wherein.

DESCRIPTION OF THE PREFERRED EMBODIMENTS OF THE INVENTION

The embodiment described refers to an internal combustion engine with auto ignition having a supercharger for the supply of air to the engine. The value of this quantity of air supplied to the engine is determined by means of sensors sensing the supercharger air temperature, the pressure of the charging air and the rotational speed of the internal combustion engine. The rotational speed of the internal combustion engine is determined by a tachometer. The amount of fuel to be injected into the internal combustion engine is computed by an electronic control unit. This control unit is connected to the relevant sensors and the fuel metering apparatus of the internal combustion engine and includes a suitably programmed microprocessor.

Figure 1:
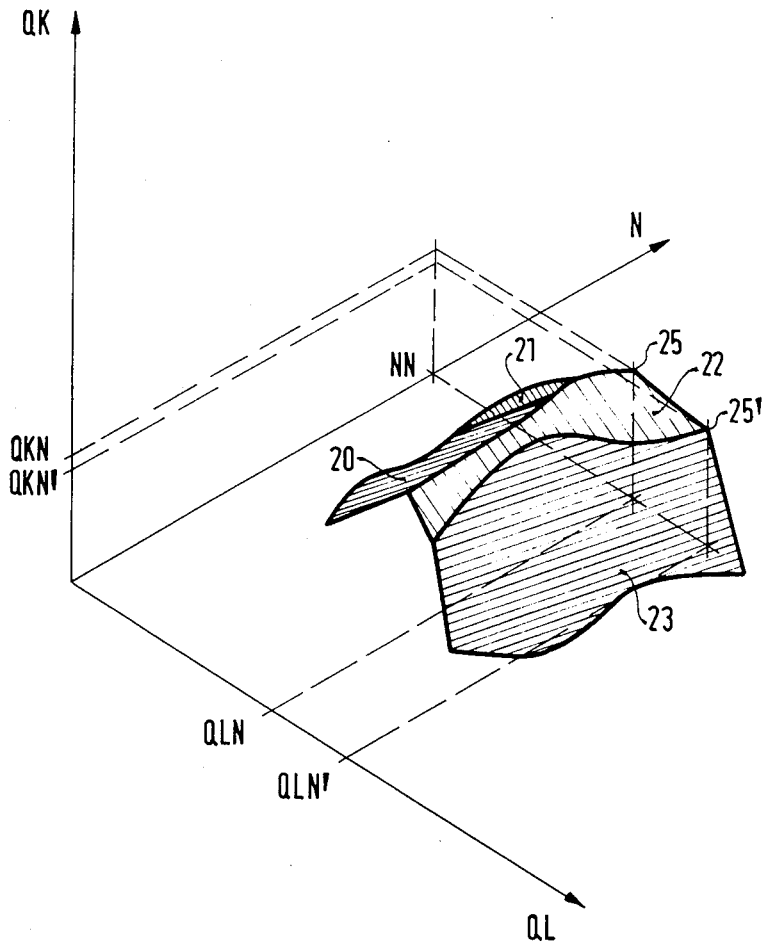
FIG. 1 is a three-dimensional graph showing the full-load field of characteristics of an internal combustion engine.

FIG. 1 of the drawing illustrates a three-dimensional full-load field of characteristics of an internal combustion engine. Fuel quantity QK, air quantity QL and rotational speed N are shown along the three axes of the coordinate system. The field of characteristics of FIG. 1 includes four surfaces located in various positions within the space defined by the coordinate system.

Reference numeral 20 identifies a surface representing the smoke limit of the internal combustion engine. If this limit were exceeded in the direction of a larger quantity of injected fuel, this would mean that the pollutant emissions of the exhaust gases of the internal combustion engine have exceeded their permissible limit. Reference numeral 21 identifies the limit surface predeterminative by the maximum permissible exhaust gas temperature. If this temperature limit were exceeded because of the injection of additional fuel, dangerous overheating of the internal combustion engine would ensue. Reference numeral 22 denotes a surface of constant torque at a constant rotational speed and will be considered in more detail later. Reference numeral 23 identifies a limit surface which is defined by the maximum permissible combustion pressure in the combustion chambers of the internal combustion engine. If, as a result of more fuel injected, this surface and consequently also the maximum permissible pressure are exceeded, major damage to the internal combustion engine may result.

In the three-dimensional coordinate system of FIG. 1, a further rotational speed NN is plotted, with air quantity QLN being supplied to the internal combustion engine by the supercharger, resulting in the supply of fuel quantity QKN to the internal combustion engine. This load condition of the internal combustion engine is assigned reference numeral 25 in the three-dimensional field of characteristics of FIG. 1. The torque delivered by the internal combustion engine at the load designated by reference numeral 25 is delivered along the whole line connecting operating conditions 25 and 25'. The relevant load depends on the air quantity QL supplied to the internal combustion engine. From this, the condition results that at a constant rotational speed NN, the air quantity range QLN to QLN' causes a fuel quantity within the fuel quantity range QKN to QKN' to be injected which is just sufficiently large to have the internal combustion engine deliver consistently the same torque under all these loads.

Figure 2:
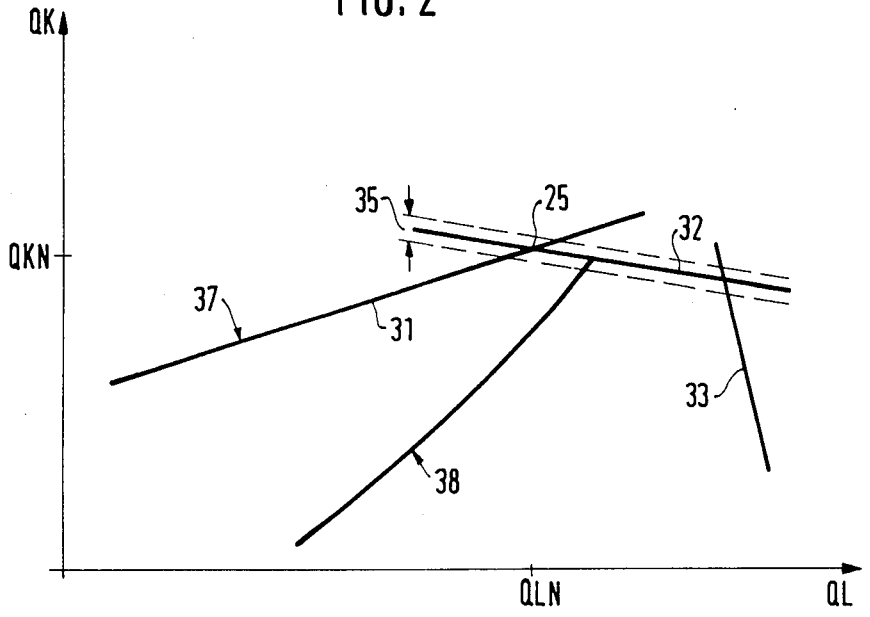
FIG. 2 is a graph showing a full-load characteristic at a specific rotational speed; and, FIG. 3 is a three-dimensional graph of a full-load field of characteristics.

FIG. 2 shows a full-load characteristic of an internal combustion engine at a specific rotational speed. This full-load characteristic results from the full-load field of characteristics of FIG. 1 by restricting this field of characteristics to a specific rotational speed. Thus, the three-dimensional characteristic field QK=f(QL, N) reduces to the two-dimensional characteristic QK=f(QL, N=NN). Accordingly, the point in FIG. 2 identified by reference numeral 25 corresponds to the point of FIG. 1 carrying the same reference numeral.

Reference numeral 31 identifies the exhaust gas temperature limit of the internal combustion engine at rotational speed NN, the line identified by reference numeral 32 denotes the constant torque line, and the limit line of the maximum combustion pressure is identified by reference numeral 33. Reference numeral 37 identifies the full-load characteristic of the internal combustion engine, whereas one of the part-load characteristics of the internal combustion engine is assigned reference numeral 38.

The limit surfaces shown in FIG. 1, namely, the smoke limit, the exhaust gas temperature limit and the maximum compression pressure limit, which also occur in FIG. 2 as limit lines at specific rotational speed NN, are determined at the time of development of the internal combustion engine, for example, by means of tests. Now it would be possible to determine the full-load limitation of the internal combustion engine only by means of these three limit surfaces. However, especially with regard to the adjustment of the individual internal combustion engines in series production, it has proved to be particularly advantageous to add a surface of constant torque to the three limit surfaces referred to above when determining the full-load limitation of the internal combustion engine. By introducing this surface of constant torque, it is achieved that in specific ranges of the air quantity supplied to the internal combustion engine by the supercharger, the amount of fuel injected is always just sufficient to cause the internal combustion engine to produce a constant torque at a constant rotational speed, the torque being independent of the air quantity. In FIG. 1, this range is represented by limit surface 22.

In FIG. 2, limit line 32 always defines the quantity of fuel required for injection to obtain a constant torque at a specific rotational speed, for example rotational speed NN, and a specific measured quantity of air. In a particularly advantageous manner, this constant torque limit line makes it possible that, in the series production of internal combustion engines, all engines of a series are adjusted to the same torque by shifting this constant torque limit line at a specific predeterminative rotational speed, for example, NN. In FIG. 2, this shift of the constant torque limit line 32 is identified by reference numeral 35.

Figure 3:
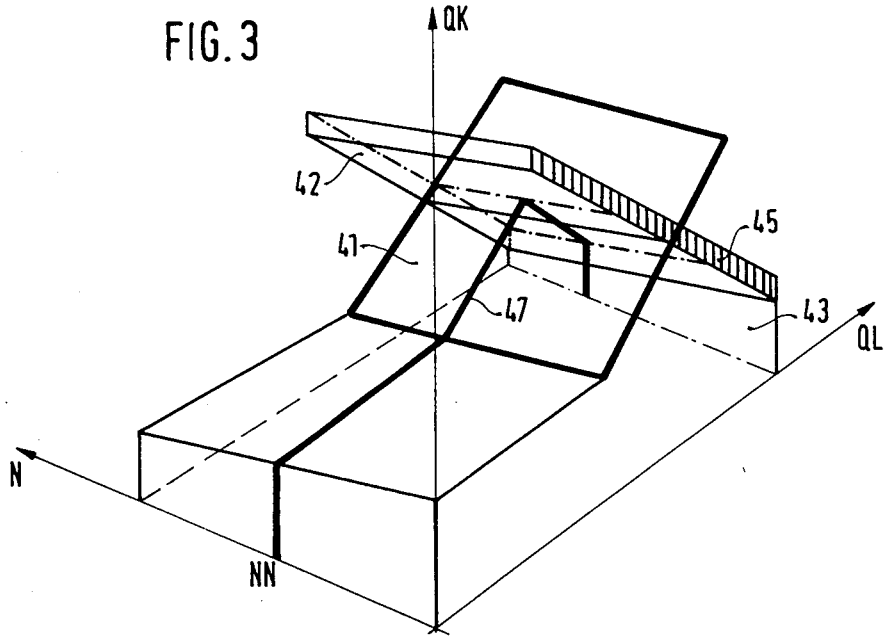

Shifting the constant torque limit line as illustrated in FIG. 2 causes the entire constant torque limit surface, as shown in FIG. 1, to be likewise shifted. For series produced internal combustion engines, this means that all the individual engines, following torque adjustment, are injected with an amount of fuel just sufficient to produce identical torques within a specific range of air supplied and over the entire speed range. It is particularly advantageous herein that in torque adjustment only the constant torque limit surface is shifted and that all other limit surfaces, that is, smoke limit, exhaust gas temperature limit and the maximum combustion pressure limit, are not affected by the shift. This means that these limits are identical for all internal combustion engines of a series. This relationship is illustrated in FIG. 3 of the drawing showing a schematic of a full-load field of characteristics of an internal combustion engine. Reference numeral 41 identifies the exhaust gas temperature limit surface, reference numeral 43 the maximum combustion pressure surface, and the constant torque limit surface is assigned reference numeral 42. Reference numeral 45 denotes the shift of the constant torque reference surface 42.

In FIG. 3, reference numeral 47 identifies the full-load characteristic of a specific internal combustion engine operating at rotational speed NN. A comparison of full-load characteristic 37 of FIG. 2 with full-load characteristic 47 shows that characteristic 47 differs from characteristic 37 precisely by shift 45. Therefore, characteristic 47 represents the characteristic of a specific internal combustion engine of a series, whereas characteristic 37 illustrates the general characteristic of the internal combustion engine.

In other words, this means that characteristic 37 is a desired characteristic which all internal combustion engines of a series should have when producing torques in the constant torque range, but which they normally do not have because of manufacturing tolerances. By contrast, characteristic 47 is the actual characteristic of a specific internal combustion engine in which the existing manufacturing tolerances have been compensated for by the shift 45 of the constant torque limit surface 42. The shift is carried out in such a way that all internal combustion engines produce the same torque at a specific rotational speed.

Consequently, the essence of the invention is that only a specific range of the full-load field of characteristics is influenced for the adaptation of several individual internal combustion engines. For this purpose, the embodiment described provides for shifting of a surface of constant torque such that this torque has a specific value for all internal combustion engines of the series.

In the following, an application of the described method for the full-load limitation of an internal combustion engine will be explained by way of example. For this purpose, tests have to be conducted first in the development of an internal combustion engine to determine its optimum limit surfaces, that is, smoke limit, exhaust gas temperature limit and maximum combustion pressure limit, in dependence upon the rotational speed and the amount of air supplied to the internal combustion engine. Then the constant torque limit surface is determined, for example, with a view to obtaining an optimum torque pattern for the internal combustion engine. The full-load characteristic field of the internal combustion engine is thereby complete and ready for storage in the electronic control unit.

At this point, however, this field of characteristics does not yet consider the manufacturing tolerances occurring in the production of the individual internal combustion engines. These tolerances are compensated for following the manufacture of each individual engine. For this purpose, each engine is run on a test stand at a specific speed. Then it is set so as to produce a specific predeterminative output torque by means of an adjusting device, for example, a potentiometer, provided at the electronic control unit. The setting by means of the adjusting device results in a shift of the constant torque limit surface (see FIG. 3). Therefore, after the individual internal combustion engines have been set, all engines have the same torque at the specific rotational speed. At the same time, however, all engines also have the same limit surfaces with respect to exhaust gas temperature, maximum combustion pressure and smoke. In the operation of the internal combustion engine, the electronic control unit will always select the smallest fuel quantity which is defined by one of the limit surfaces at a specific rotational speed and at a specific relevant air quantity. Thus, it is always a minimum value selection that takes place in respect to the limit surfaces.

In the embodiment described, the constant torque limit surface was always shifted, with the magnitude of the shift dependent upon a specific predeterminative torque value. Under certain conditions, it may be particularly advantageous not only to shift but also to rotate the constant torque limit surface. For this purpose, one or several additional adjusting devices may be required.

In the embodiment described, the parameters of the full-load field of characteristics were the rotational speed of the internal combustion engine, the amount of air supplied to the internal combustion engine, and the fuel quantity to be injected. It is to be understood, however, that the invention is not restricted to these parameters of the embodiment. For example, air mass, fuel mass and the like may also be used as parameters of the internal combustion engine.

Further, the invention is not only suitable for use with diesel engines but also with all engines equipped with the full-load limitation feature. In this case it is possible that other parameters are substituted for the limit surface parameters described in the embodiment, that is, exhaust gas temperature, smoke, et cetera.

Finally, it is to be understood also that the limit surface to be shifted need not necessarily be a limit surface of constant torque as described in the embodiment, but may also be another operating parameter of the internal combustion engine, as applies equally to the adjustment criterion determining the shift. Further, it is also possible not to use an analog device, for example, a potentiometer, as the adjusting device for influencing the full-load field of characteristics; instead, a digital device, for example, a memory store can be used, to which the relevant value is applied. The only requirement is that the relevant value can be applied to the control unit externally.

It is understood that the foregoing description is that of the preferred embodiments of the invention and that various changes and modifications may be made thereto without departing from the spirit and scope of the invention as defined in the appended claims.

What is claimed is:

1. Method for determining the full-load limit of an internal combustion engine with a predeterminative full-load field of characteristics which is at least two-dimensional and which determines the dependence of the maximum mass of fuel to be supplied to the engine from at least the rotational speed thereof, the method comprising the step of influencing only one specific region of the full-load field of characteristics for adapting a plurality of said engines to each other, predeterminative full-load field of characteristics consisting of a plurality of predeterminative planes and determining the dependence of said maximum mass of fuel on the rotational speed of the engine and on the mass of air delivered to the engine, said specific region to be influenced being one of said predeterminative planes; and, determining said predeterminative planes by means of specific operating conditions of the internal combustion engine, said specific operating conditions being the maximum permissible exhaust gas temperature, the maximum permissible combustion pressure, and specific compositions of the exhaust gases of the internal combustion engine.

* * * * *